United States Patent [19]

Ciaffone

[11] 4,308,663

[45] Jan. 5, 1982

[54] RAZOR HANDLE WITH LATCH FOR PIVOTABLE CARTRIDGE

[75] Inventor: John T. Ciaffone, Bridgeport, Conn.

[73] Assignee: Warner-Lambert Company, Morris Plains, N.J.

[21] Appl. No.: 108,746

[22] Filed: Dec. 31, 1979

[51] Int. Cl.[3] ..... B26B 21/52

[52] U.S. Cl. ..... 30/87; 30/89

[58] Field of Search ..... 30/47, 85, 87, 89, 332

[56] References Cited

U.S. PATENT DOCUMENTS

| | | | |
|---|---|---|---|
| 2,709,297 | 5/1955 | Mikles | 30/89 X |
| 3,975,820 | 8/1976 | Torance | 30/89 X |
| 4,026,016 | 5/1977 | Nissen | 30/89 X |
| 4,057,896 | 11/1977 | Trotta | 30/89 |
| 4,094,063 | 6/1978 | Trotta | 30/89 X |
| 4,198,746 | 4/1980 | Trotta | 30/47 |

FOREIGN PATENT DOCUMENTS

| | | | |
|---|---|---|---|
| 95521 | 4/1924 | Austria | 30/89 |

*Primary Examiner*—Nicholas P. Godici

*Attorney, Agent, or Firm*—S. A. Schneeberger; R. S. Strickler

[57] ABSTRACT

A razor handle with a pair of pivot-engaging arms or jaws includes a resilient cartridge latching mechanism formed substantially integrally therewith. The latching mechanism is positioned to retainedly engage a pivotable cartridge in a substantially fixed angular position at one extreme of its pivot range. The cartridge is rotated into and out of the retained engagement with the latch by the user applying, normally manually, a rotational force to the cartridge, which force is of a magnitude greater than normally encountered during shaving.

5 Claims, 7 Drawing Figures

RAZOR HANDLE WITH LATCH FOR PIVOTABLE CARTRIDGE

BACKGROUND OF THE INVENTION

This invention relates to wet shaving systems using blade cartridges, and particularly to razor handles adapted for engaging blade cartridges that are pivotable about their major axis during shaving.

Most wet shaving systems available today use blade cartridges rather than blades alone as the replaceable elements of the system. The cartridges allow precise location and orientation of the blade in its support structure, and are even more necessary for the use of dual blade systems, where two cutting edges are located in a cartridge in a precise relationship.

A variety of techniques is used for attaching cartridges to razor handles. One popular technique utilizes a dovetail coupling arrangement between the handle and cartridge to fix the cartridge on the handle at a desired angle. An example of such a system is seen in U.S. Pat. No. 3,783,510 for RAZOR HAVING TANDEMLY MOUNTED BLADES BONDED IN A DISPOSABLE CARTRIDGE issued to Dawidowicz et al. Furthermore, some techniques include the significant addition of attaching the cartridge to the handle in a way that allows the cartridge to pivot in a controlled way, about its major axis. Pivotal attachment of the cartridge allows the blade mounted in the cartridge to follow skin surface contours independently of the handle orientation. The cartridge is pivotable between limits and ordinarily is biased toward a preferred neutral angular position vis-a-vis the handle. Furthermore, a portion of the cartridge ordinarily has a camming surface that is adapted to meet a cam follower on the handle when the cartridge is attached. For example, Nissen et al (U.S. Pat. No. 4,083,104) shows a reusable razor system in which a pivotable blade cartridge with a camming surface is engaged by a spring-biased cam follower forming part of the razor handle. The camming surface and cam follower coact to urge the cartridge to or toward its neutral position.

In yet another example, U.S. Ser. No. 108,741 for ONE-PIECE RAZOR HANDLE FOR PIVOTABLE CARTRIDGE filed Dec. 31, 1979, by the present applicant, there is disclosed a simple one-piece plastic razor handle for mounting a pivotable cartridge. A cantilevered cam follower formed integrally with the handle acts to urge the blade cartridge to its neutral position. This entire combination may be disposable if no provision is made for disengaging the cartridge from the razor handle after it is used. On the other hand, the one-piece handle may be formed such that by squeezing the handle the mounting jaws resiliently open to receive or release a pivotable cartridge, thereby affording at least some reusability of the system. This latter arrangement is disclosed in U.S. Ser. No. 108,742 for ONE-PIECE RAZOR HANDLE filed Dec. 31, 1979, by the present applicant.

Recently, certain blade cartridges have been provided with a dovetail type coupling structure for fixed mounting to an appropriate handle and a pivot-type coupling structure for pivotal mounting to another appropriate handle. An example of such a cartridge is found in U.S. Design Ser. No. 946,389 for SAFETY RAZOR CARTRIDGE WITH CLEAN-OUT DEVICE filed Sept. 27, 1978, by Evan N. Chen, and marketed under the trade name SCHICK ® Ultrex II.

While the pivotable razor system offers certain contour-following advantages during shaving, there are situations such as the trimming of sideburns, etc., in which the user may prefer to have a fixed razor system. Certain efforts have been made to provide a locking mechanism in pivot-type razor handles such that the pivotable cartridge may be locked in a fixed position. One such arrangement is disclosed in U.S. Pat. No. 3,938,247 for SHAVING SYSTEM WITH PIVOTAL HEAD issued Feb. 17, 1976, to Carbonell et al. This arrangement, and at least one other similar one marketed in Japan by the Feather Safety Razor Company, Ltd., provide relatively complex locking mechanisms which form separate and movable portions of the razor handles. Such locking arrangements may be relatively bulky in appearance and are costly to manufacture and assemble.

Accordingly, it is an object of the invention to provide a razor handle having a simple and inexpensively manufactured means for latching a pivotable cartridge in a fixed position. It is another object to provide a razor handle having such a latch, which latch is releasable so as to selectively return the cartridge to a pivoting mode. It is a further object to provide such latching means on a one-piece razor handle. It is still a further object to provide such latching means in a form particularly suited for use with blade cartridges of the type which may be mounted on either a fixed or a pivot-type razor handle.

SUMMARY OF THE INVENTION

A razor handle with a pair of pivot-engaging arms or jaws includes a resilient cartridge latching mechanism formed substantially integrally therewith. The latching mechanism is positioned to retainedly engage a pivotable cartridge in a substantially fixed angular position at one extreme of its pivot range. The cartridge is rotated into and out of the retained engagement with the latch by the user applying, normally manually, a rotational force to the cartridge, which force is of a magnitude greater than normally encountered during shaving.

In a preferred embodiment, the razor handle is of one piece having a single resilient latch formed integrally therewith and positioned to latch a pivotable cartridge at the "downward" extreme of its pivoting range. This embodiment is particularly suited for use with those pivotable cartridges which also possess coupling structure for use on fixed-type razor handles. Alternate embodiments may provide for the resilient latch to be a unitary, and relatively non-movable part of a more complex, multi-part razor handle, and/or for it to engage and latch a pivot-type cartridge which does not possess the coupling structure additionally required for use on a fixed-type razor handle.

DESCRIPTION OF THE PREFERRED EMBODIMENTS

Figure 1:
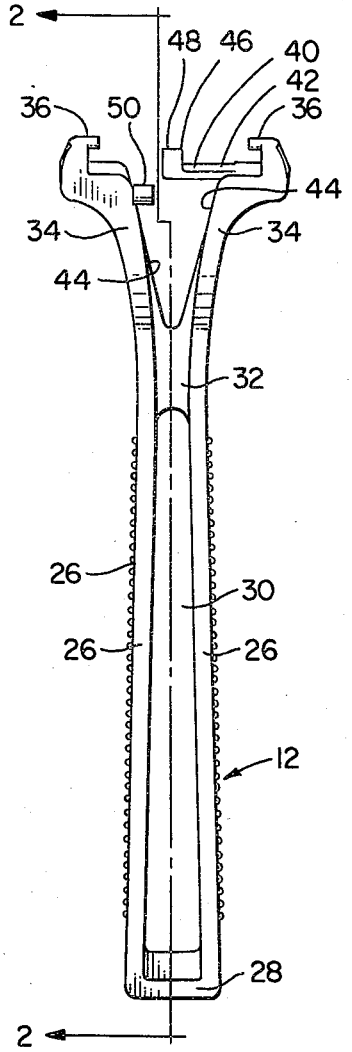
FIG. 1 is a front elevational view of a razor handle in accordance with the invention.
Figure 2:
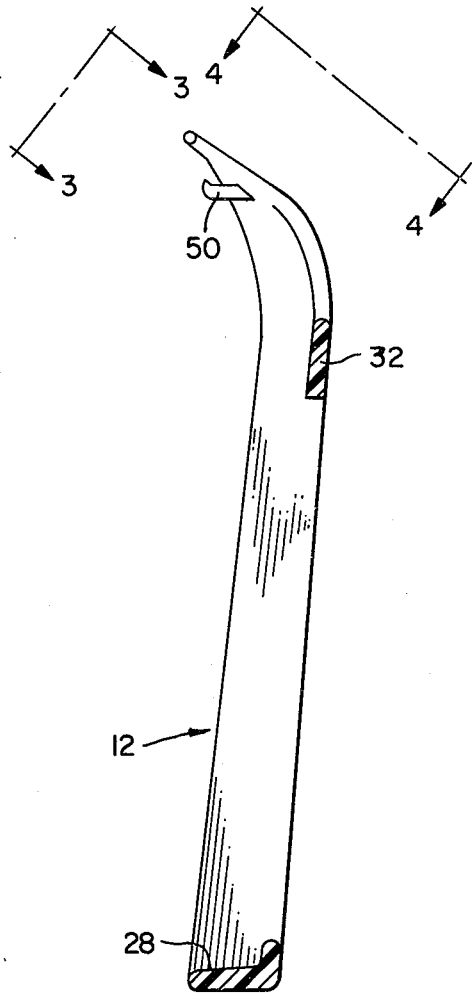
FIG. 2 is a vertical section of FIG. 1 taken along line 2—2 thereof.
Figure 3:
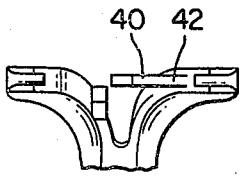
FIG. 3 is a rearwardly inclined, front elevational view of the upper portion of the razor handle.
Figure 4:
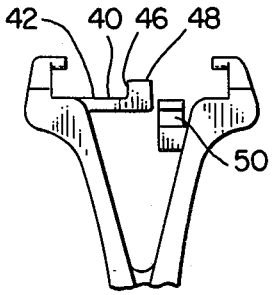
FIG. 4 is a partial view of the razor handle taken orthogonal to FIG. 3 and looking down upon the pivot trunnions.
Figure 5:
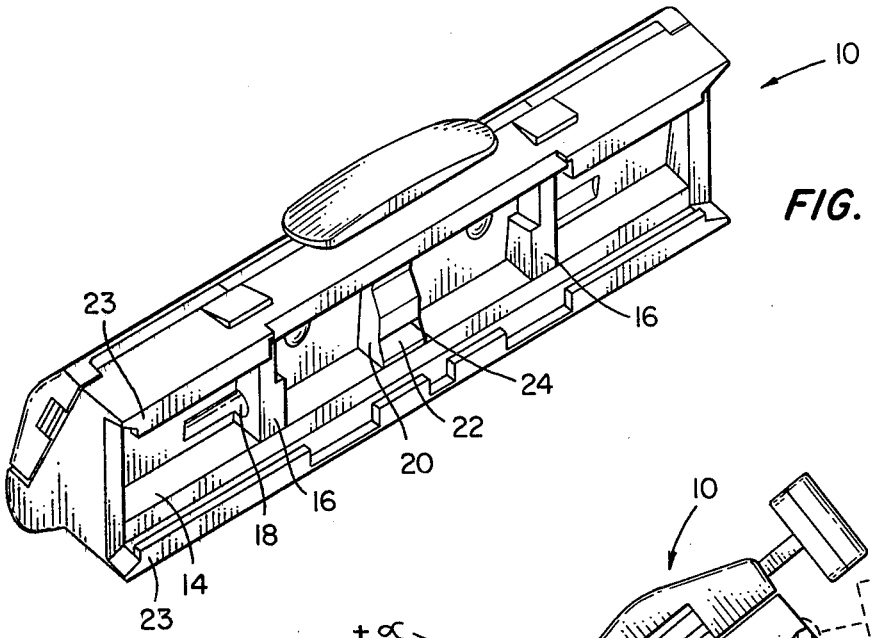
FIG. 5 is a rear, underside perspective view of a typical razor blade cartridge having coupling structure for both pivotable and fixed-type razor handles.
Figure 6:
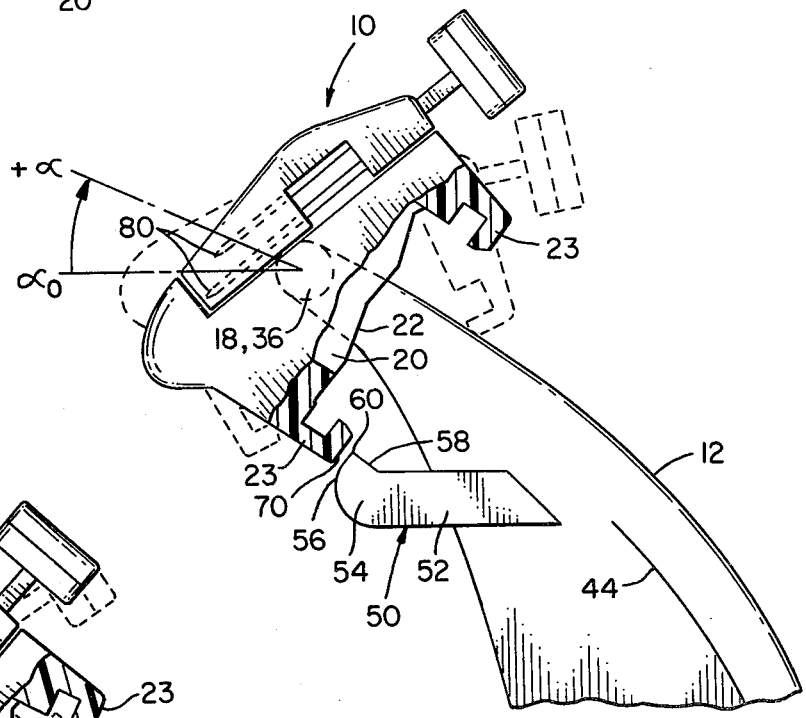
FIG. 6 is a partial view of FIG. 2, additionally illustrating a pivotable cartridge mounted thereon in certain angular orientations.
Figure 7:
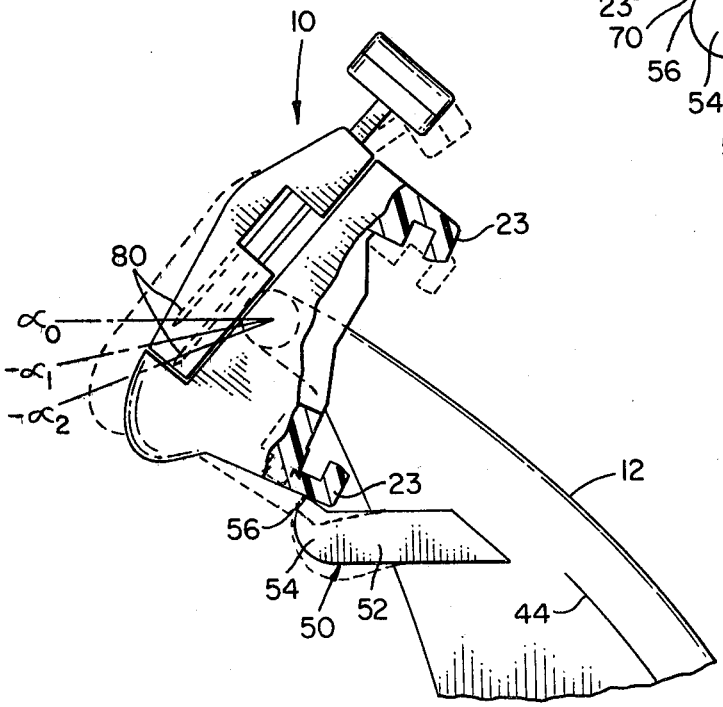
FIG. 7 is a view similar to FIG. 6 with the cartridge illustrated in certain other angular orientations involving the latch of the invention.

FIG. 1 shows a razor handle 12 constructed according to the invention. Razor handle 12 is suited to receive a pivotable razor blade cartridge 10 such as illustrated in FIGS. 5–7. The cartridge 10 is preferably of the type disclosed in the aforementioned U.S. Design Application Ser. No. 946,389, which is incorporated herein by reference. The cartridge rear or undersurface 14 includes a pair of horizontally spaced, vertical wall members 16 projecting rearwardly. Each wall member 16 has a horizontally extending aperture 18 facing outwardly for engagement by inwardly extending trunnions on the jaws of a razor handle.

The cartridge rear surface 14 also includes a central rearwardly projecting wall 20 with a camming surface 22 facing rearwardly. The camming surface 22 is most shallow, or extends forwardmost, at a horizontal midline or apex 24 and extends gradually more rearwardly on either side of the midline 24.

The cartridge rear surface 14 further includes a pair of opposed "U" shaped channel members 23 extending horizontally substantially the entire length of cartridge 10. Channel members 23 are adapted to receive a complementary pair of elongated rails on the head of a so-called "fixed-head" razor handle so as to be fixedly mounted on the handle. This coupling arrangement is described in greater detail in aforementioned U.S. Pat. No. 3,783,510 (Dawidowicz et al), incorporated herein by reference.

The razor handle 12 is a single piece open frame, molded from a plastic that provides some resiliency in the frame elements. The handle 12 includes two spaced-apart vertical side walls 26 rising from a solid base portion 28. Above the base 28, the walls 26 form a slot 30 between them, the slot 30 terminating at its upper part with a neck 32 extending from one side wall 26 to the other.

Above the neck 32, the razor handle walls 26 diverge to form a pair of spaced, jaw-like upper arms 34 terminating with cartridge-engaging, horizontally inwardly extending pivot trunnions or fingers 36 for engaging the apertures 18 of the blade cartridge 10. The arms 34 are responsive either to squeezing of the handle side walls 26 or to a mechanical wedge temporarily inserted between the arms 34 to spread the arms sufficiently to receive a cartridge.

The cartridge 10 is pivotable about an axis extending through the fingers 36 when it is engaged in the manner set out above. A cam follower 40 is also formed as part of the razor handle 12 and comprises a generally L-shaped cantilever beam portion thereof. It has a base portion 42 extending horizontally inwardly parallel the fingers 36 from the inside surface 44 of one of the arms 34. The base portion 42 is joined to a central portion 46 extending generally horizontally toward the cartridge 10 midway between arms 34 and terminating in a cam follower edge 48. The cam follower edge 48 is located so that when the cartridge 10 and handle 12 are engaged via the handle fingers 36, the edge 48 abuts the cam surface 22 at its midline 24. Moreover, the edge 48 applies a preload biasing force to cam surface 22 to ensure that the cartridge 10 assumes a desired neutral angle in the absence of shaving forces. This cam follower 40 is resiliently flexible about a horizontal axis aligned generally with the base portion 42 so that the cam follower edge 48 is movable in a generally vertical direction. Rotational displacement of cartridge 10 from its neutral angle, as by a change in the contour of the surface being shaved, serves to vertically displace cam follower edge 48 which in turn acts to restore the cartridge to its neutral angle.

In accordance with the present invention and referring to FIGS. 1–4, 6 and 7, a locking or latching mechanism, here embodied in cantilever latching beam 50, also comprises a unitary, and here integral, portion of handle 10. The latching beam, or simply latch, 50 has a base portion 52 extending substantially horizontally forward from the inside surface 44 of the arm 34 other than that from which cam follower 40 extends. The latching beam 50 is thus offset transversely from cam follower 40 and the midline of razor 12 by a small distance. The latching beam 50 extends upwardly a very short distance at its forward end to form a detent portion 54. The detent portion of latch 50 includes a pair of front and rear camming surfaces 56 and 58 respectively which are oppositely inclined such that they converge in the general direction of the pivot axis defined by fingers 36. Preferably the camming surfaces converge to an apex 60 which is parallel to the pivot axis and only a very small distance, for instance 0.01–0.03 inch, above the remainder of latching beam 50. However, the detent portion 54 is positioned such that it extends slightly into the arcuate path of the outer edge or knee 70 of forward channel member 23. The relative angles of forward and rear camming surfaces 56 and 58 to the arcuate path of cartridge channel member knee 70 are selected to facilitate the latching and unlatching of cartridge 10, but only upon the application of sufficient respective latching and unlatching forces.

The length of latching beam 50 from its base to the detent 54 is sufficient, in view of its cross-sectional geometry and the material used, to be resiliently deflectable in a downward direction when the outer edge 70 of cartridge channel member 23 engages the detent forward camming surface 56 in response to a rotational force, usually manual, which is somewhat greater than normal shaving forces. This resilient deflectability of latching beam 50 is sufficient to allow cartridge edge 70 to pass over detent apex 60 and be then retained or captured between the detent 54 and the forward surfaces of the razor handle arms 34. In this captured orientation the cartridge 10 has little or no freedom to rotate and thus essentially fixes the angle which the cutting edges 80 of its blades assume relative to the vertical portion of handle 12.

Referring specifically to FIG. 6 in which a portion of cartridge 10 and handle 12 have been removed to reveal the coupling mechanism and the latching beam 50, the cartridge 10 is illustrated in solid lines as assuming the neutral rotational or angular orientation $\alpha_o$ relative to handle 12. This neutral angle $\alpha_o$ orients the blade edges 80 of the cartridge 10 at a pre-selected desired angle relative to the main extent of handle 12, normally about 55°–65°. The neutral angle $\alpha_o$ is obtained by the cam follower 40 (omitted from FIG. 6) acting against cam surfaces 22, as earlier described. In response to upwardly directed shaving/frictional forces on the front or blade side of cartridge 10, the cartridge is rotated upwardly (clockwise in FIG. 6) by an amount determined by the forces and reaches a maximum angle of $+\alpha$ when the rear channel member 23 contacts the rear surface of handle 12, as illustrated by dotted lines in FIG. 6. Typically, the upward angle limit $+\alpha$ is about $+25°$ relative to neutral angle $\alpha_o$.

The latching arrangement of the invention is operative when the cartridge 10 is rotated to the downward (or counterclockwise in FIG. 7) limit $-\alpha_2$ of its angular range, as illustrated in solid lines in FIG. 7. In this orientation, the outer edge or knee 70 of the cartridge's forward channel member 23 will have been manually rotated over the latch detent 54 and will be captured between that detent and the forward surface of handle 12. In fact, a forward surface of channel member 23 contacts detent 54 at its apex 60 and is maintained by the centering bias of cam follower 40. Typically, this downward angle limit $-\alpha_2$ is about $-18°$ to $-20°$ relative to neutral angle $\alpha_o$. The latching beam 50, with its detent 54, serves to retain the cartridge at this predetermined orientation, represented by $-\alpha_2$, until released from the latch by manually applying a sufficient releasing force (in the clockwise direction in FIG. 7). While retained in this latched position, the razor may be used for precise operations such as the trimming of sideburns.

The cartridge 12 is afforded ample free downward rotation from the neutral angle $\alpha_o$ before it encounters interference from detent 54 of the latching beam 50. Typically, cartridge 10 may rotate downward by an angle of $-\alpha_1$ relative to $\alpha_o$ before the forward channel member 23 of cartridge engages the front camming surface 56 of latch detent 54, as illustrated in dotted lines in FIG. 7. Typically, $-\alpha_1$ is about $-10°$ relative to $\alpha_o$. This comprises a lower limit to the free rotation of cartridge 10.

During the act of latching the cartridge 10, it is manually rotated counterclockwise (in FIG. 7) over detent 54, which in turn depresses the resilient latching beam 50, as also illustrated in dotted line in FIG. 7. The upward return of latching beam 50 serves to retain the cartridge 10 in its latched position.

The range of free pivoting of cartridge is from $-\alpha_1$ to $+\alpha$, or about 35°. It will be appreciated that this range may be increased and/or the position of the neutral angle $\alpha_o$ relative to $+\alpha$ and $-\alpha_1$ may be altered if so desired.

The preferred embodiment has been described and illustrated as a handle having but a single latching beam which is near, but not necessarily at, the center or midline between arms 34. It will be appreciated that two or more latching beams might be used to possibly enhance the latching power of the cumulative latches and/or provide symmetry of the latches on the handle; however, the single latch embodiment described possesses sufficient latching capability and importantly avoids the potential problem of the cartridge being engaged and retained by one latch but, because of cocking, wear and/or tolerances, not being retained by the other. The single latch arrangement is either entirely latched or unlatched, with no intermediate condition possible.

Still further, although the latching beam of the preferred embodiment is particularly suited for use with a cartridge having both pivotable and fixed coupling structures, only relatively minor modification of the latching beam's geometry is required for it to engage and retain the transversely extending ridge which parallels the blade edges in the forward underside of a cartridge of known type which possesses only pivotable coupling structure.

Finally, although the latching beam has been described in the context of a one-piece plastic razor with overall cost economy in mind, it is similarly applicable to those pivoting-type razor handles of more complex, multi-part, and sometimes plural material, design. In most such razors a plastic or metal head portion supports very short arms which contain the pivot trunnions. Because of the proximity of this head portion to the underside of a mounted cartridge, it is possible to form the latching beam as an integral extension of the plastic or metal head portion.

The present embodiments are to be considered in all respects as illustrative and not restrictive, the scope of the invention being indicated by the appended claims rather than by the foregoing description, and all changes which come within the meaning and range of equivalency of the claims are therefore intended to be embraced therein. For instance, the latch may be positioned or configured so as to capture the cartridge at its upper limit of rotation, while allowing full downward rotation.

I claim:

1. In a shaving instrument including a razor handle making pivotal engagement with a razor blade cartridge, said razor blade handle comprising a vertical body portion adapted to be held by a shaver, said cartridge being freely rotatable through a predetermined arc, spaced arms extending upwardly from said body portion, said arms including means for pivotally engaging said blade cartridge, the improvement comprising:

automatic cartridge latching means extending from said handle and positioned for retaining said blade cartridge at a predetermined angular position when said blade cartridge is rotated beyond said arc, said latching means being flexible and resiliently deflectable upon contact with said cartridge permitting said blade cartridge to rotate into and out of latching position by virtue of said flexibility, said handle being a unitary plastic member, said latching means defining a single cantilevered latching beam projecting from said handle, said blade cartridge including a camming surface for engagement with a cam follower and said handle further including a second cantilevered beam extending therefrom toward said cartridge camming surface and including a forward edge for camming engagement with said cartridge camming surface thereby urging said blade cartridge to a neutral position, both said beams being formed integrally with said handle to develop a single piece-part.

2. The razor handle of claim 1 wherein said second cantilevered beam extends from one of said arms and said cantilevered latching beam extends from another of said arms.

3. The razor handle of claim 2 wherein the forward edge of said second cantilevered beam is positioned midway between said spaced arms and said cantilevered latching beam is offset transversely from said second cantilevered beam, said latching beam including a detenting projection extending transversely therefrom for releasably retaining said cartridge at said predetermined angle.

4. The razor handle of claim 3 wherein said detenting projection on said cantilevered latching beam normally extends into the path of a portion of said blade cartridge as it is rotated toward said predetermined angle, and said detenting projection comprises a pair of oppositely inclined camming surfaces converging in the general direction of the axis about which said blade cartridge pivots thereby to facilitate said resilient deflection of said cantilevered latching beam from its normal position when said blade cartridge is reversibly rotated either into or out of said predetermined angle.

5. The razor handle of claim 4 wherein said blade cartridge includes at least one cutting edge and is pivotable to incline said cutting edge both upwardly and downwardly to respective limits relative to a neutral position and said cantilevered latching beam is positioned such that said predetermined angle at which said blade cartridge is retained serves to incline said cutting edge downwardly at said respective limit.

* * * * *